US006461217B1

(12) United States Patent
Pestonji

(10) Patent No.: US 6,461,217 B1
(45) Date of Patent: Oct. 8, 2002

(54) TALKING DOLL HAVING EXTENDIBLE APPENDAGES

(75) Inventor: Danutcha Pestonji, Burbank, CA (US)

(73) Assignee: Mattel, Inc., El Segundo ( * ) Notice: Subject to any disclaimer, the term of this patent is extended or adjusted under 35 U.S.C. 154(b) by 0 days.

(21) Appl. No.: 09/633,047

(22) Filed: Aug. 4, 2000

(51) Int. Cl.[7] ..... A63H 3/28
(52) U.S. Cl. ..... 446/297; 446/300; 446/489
(58) Field of Search ..... 446/297, 300, 446/301, 330, 390, 376, 489

(56) References Cited

U.S. PATENT DOCUMENTS

| | | | | | |
|---|---|---|---|---|---|
| 3,162,980 | A | | 12/1964 | Hellman | |
| 3,755,960 | A | | 9/1973 | Tepper et al. | |
| 3,977,292 | A | | 8/1976 | Favilli et al. | |
| 4,249,338 | A | | 2/1981 | Wexler | |
| 4,710,145 | A | | 12/1987 | Hall Vandis | |
| 4,795,395 | A | * | 1/1989 | Oishi et al. | 446/175 |
| 4,889,027 | A | | 12/1989 | Yokoi | |
| 4,950,200 | A | | 8/1990 | Curran | |
| 5,088,954 | A | | 2/1992 | Terzian et al. | |
| 5,147,238 | A | * | 9/1992 | Kelley et al. | 446/330 |
| 5,295,889 | A | * | 3/1994 | Ejima | 446/91 |
| 5,376,038 | A | | 12/1994 | Arad et al. | |
| 5,468,172 | A | | 11/1995 | Basile | |
| 5,501,627 | A | | 3/1996 | Ekstein | |
| 5,738,526 | A | | 4/1998 | Cerda et al. | |
| 5,738,561 | A | | 4/1998 | Pracas | |
| 5,795,213 | A | | 8/1998 | Goodwin | |
| 6,257,948 | B1 | * | 7/1999 | Silva | 446/100 |

* cited by examiner

*Primary Examiner*—Jacob K. Ackun
*Assistant Examiner*—Bena B. Miller
(74) *Attorney, Agent, or Firm*—Roy A. Ekstrand

(57) ABSTRACT

A toy figure includes a generally spherical torso supporting a pair of outwardly extending sleeves which in turn receive a pair of slidably supported arms. A second pair of sleeves supported on the torso receive a pair of slidably supported legs. An additional sleeve is positioned upon the toy figure head and receives a slidably supported shaft having a ball member at its outer end. A plurality of switches are positioned within the toy figure and are actuated as the arms, legs and head shaft are moved inwardly and outwardly. A sound circuit is supported within the toy figure and is responsive to actuation of the various switches therein to produce audible message or sound effects. The toy figure head further supports a pair of ears slidably movable in a lateral direction within the head.

7 Claims, 2 Drawing Sheets

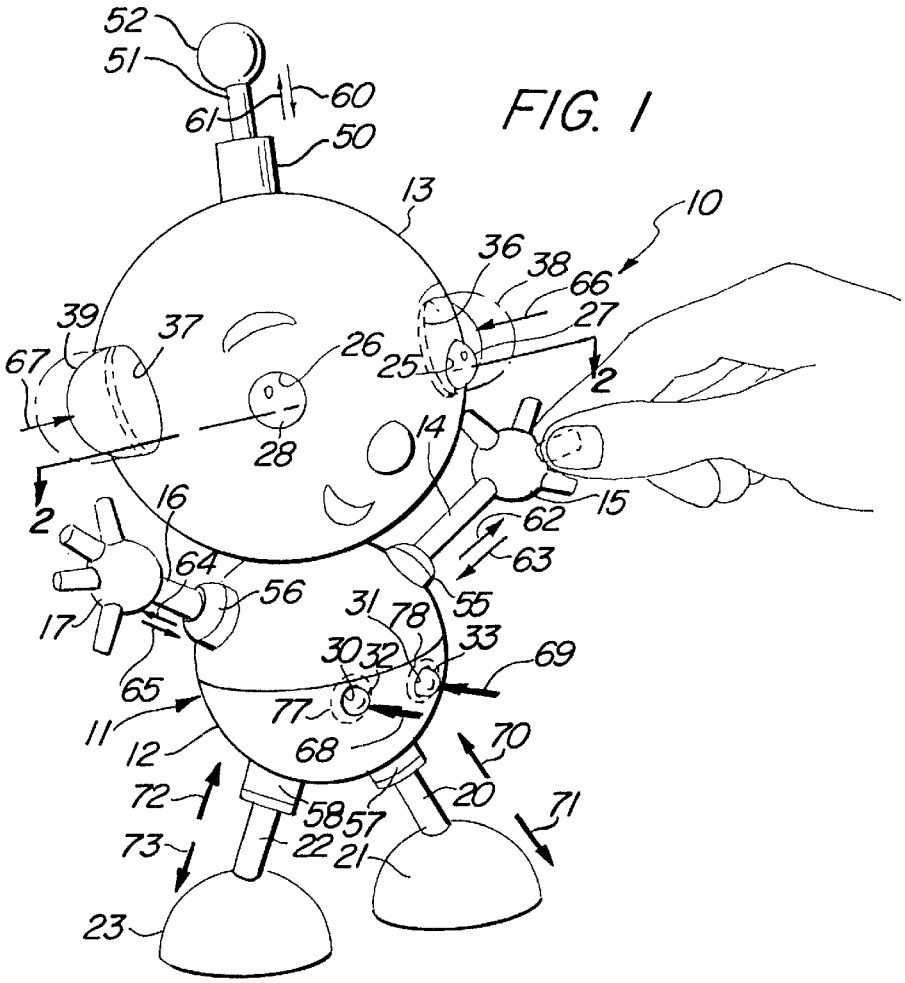
FIG. 1
FIG. 2
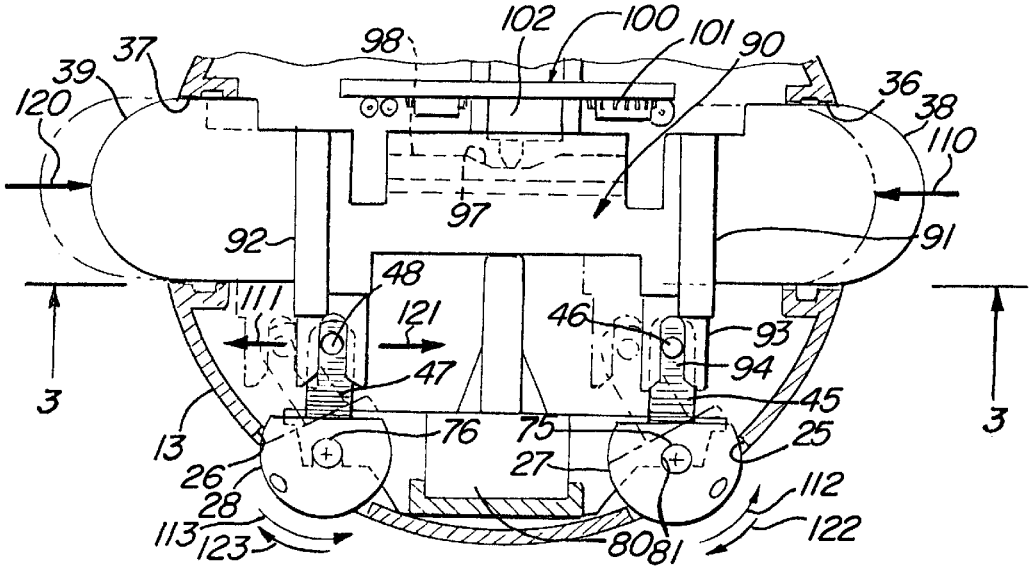

TALKING DOLL HAVING EXTENDIBLE APPENDAGES

FIELD OF THE INVENTION

This invention relates generally to sound producing dolls and particularly to those which emit sound in response to appendage manipulation.

BACKGROUND OF THE INVENTION

Dolls which speak or otherwise produce sound effects are well known in the art and have become very popular. With the advent of low cost, high performance, mass produceable digital electronic sound circuitry, a dramatic growth in the number and variety of sound producing dolls has occurred. Such digital electronic sound systems facilitate fabricating virtually an entire sound producing circuit within a single integrated circuit "chip". When such small digital electronic sound apparatus is combined with correspondingly small, low cost audio transducers such as piezo-electric devices, even the smallest and lowest cost doll may be enhanced with sound producing features.

Many sound producing dolls utilize a plurality of switches distributed about the doll body which are operatively coupled to the sound producing circuit. Often, different switches trigger the production of different sounds. For example, U.S. Pat. No. 3,977,292 issued to Favilli, et al. sets forth a FIGURE TOY HAVING TUNED SOUND PRODUCERS AND INDICIA in which sound producers are supported in different parts of a figure toy and are identified by visible indicia such that different tones may be produced in a predetermined sequence. The sound producers may produce musical notes, vowels or the like.

U.S. Pat. No. 3,755,960 issued to Tepper, et al. sets forth a DOLL GIVING PARTICULAR VOCAL RESPONSES TO MOVEMENT OF PARTICULAR APPENDAGES in which a doll includes a sound producing apparatus together with a variety of switch means actuated by appendage movement. Each switch when actuated evokes a different sound output from the sound circuitry.

U.S. Pat. No. 4,950,200 issued to Curran sets forth a WHISPERING DOLL having a human child-like doll having a switch located in the chest area and a switch supported in the hand. In response to switch manipulation, a tape mechanism within the doll plays a whispered message.

U.S. Pat. No. 5,376,038 issued to Arad, et al. sets forth a DOLL WITH PROGRAMMABLE SPEECH ACTIVATED BY PRESSURE ON PARTICULAR PARTS OF HEAD AND BODY in which a doll supports a sound producing apparatus and a plurality of switches located about the body. Various educational speech is programmed into the sound apparatus and is spoken as different parts of the body are manipulated.

U.S. Pat. No. 5,468,172 issued to Basile sets forth a DOLL INCLUDING RECORDED MESSAGE in which a doll supports a motorized appendage for providing a caress. A recorder supported within the doll provides a personal audible message to be played back.

U.S. Pat. No. 5,501,627 issued to Ekstein sets forth a CHILDRENS TOY WITH PEEK-A-BOO ACTIVATION having a doll supporting a pair of light sensors on the exterior face thereon and a sound producing apparatus within the doll body. The light sensors detect the proximity of a child's face and trigger the sound production.

U.S. Pat. No. 5,738,561 issued to Pracas sets forth a TALKING DOLL having a microphone and sound recording device together with a playback device and speaker supported within the doll body. A plurality of contacts or buttons are supported about the doll body to activate the recording and playback apparatus.

U.S. Pat. No. 5,795,213 issued to Goodwin sets forth a READING TOY having a toy animal figure supporting a sound producing apparatus therein having a plurality of stored messages. The toy includes an appendage for holding a book and a plurality of pressure switches operative to cause portions of the text to be audiblized.

U.S. Pat. No. 3,162,980 issued to Hellman sets forth a TALKING DOLL AND THE LIKE in which an example of an early sound producing doll is shown.

In related education and therapeutic arts, U.S. Pat. No. 5,738,526 issued to Cerda, et al. and U.S. Pat. No. 4,710,145 issued to Hall Vandis and U.S. Pat. No. 4,249,338 issued to Wexler set forth examples of such use of speaking dolls.

U.S. Pat. No. 5,088,954 issued to Terzian, et al. and U.S. Pat. No. 4,889,027 issued to Yokoi set forth related doll apparatus which includes sound effects.

While the foregoing described prior art devices have to some extent improved the art and have in some instances enjoyed commercial success, there remains nonetheless a continuing need for evermore improved, interesting and amusing talking and sound producing dolls.

SUMMARY OF THE INVENTION

Accordingly, it is a general object of the present invention to provide an improved talking doll. It is a more particular object of the present invention to provide an improved talking doll having a variety of sound effects which provides an interesting and amusing play pattern.

In accordance with the present invention, there is provided a toy figure comprising: a body having a torso and a head; a sound circuit having a stored plurality of audible sounds and an electro-acoustic transducer; a pair of arms slidably supported by the torso each movable between an inward position and an outward position and each having an interior arm end; a pair of legs slidably supported by the torso each movable between an inward position and an outward position and each having an interior leg end; a first pair of switches operatively coupled to the sound circuit, the first pair of switches supported within the torso at positions causing the switches to be actuated by movement of the arms between the inward position and the outward position; a second pair of switches operatively coupled to the sound circuit, the second pair of switches supported within the torso at positions causing the switches to be actuated by movement of the legs between the inward position and the outward position, the sound circuit responding to actuation of the switches in the first and second pairs of switches to produce audible sound.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 1 sets forth a front perspective view of a talking doll constructed in accordance with the present invention;

FIG. 2 sets forth a partial section view of the doll of FIG. 1 taken along section lines 2—2 therein;

DESCRIPTION OF THE PREFERRED EMBODIMENT

Figures 3, 4, 5:
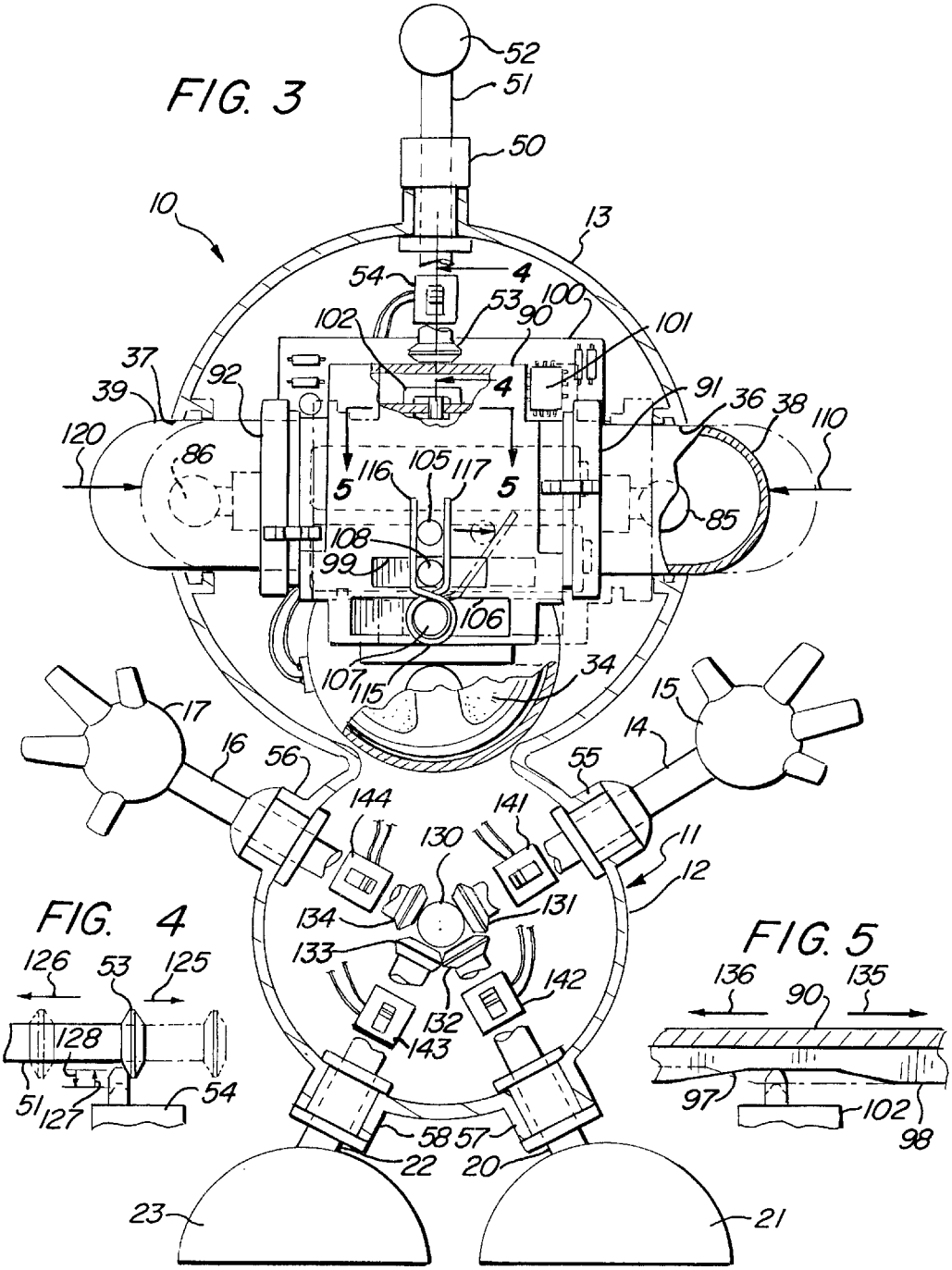
FIG. 3 sets forth a section view of the doll of FIG. 1 taken along section lines 3—3 in FIG. 2.
FIG. 4 sets forth a partial section view of the present invention doll taken along section lines 4—4 in FIG. 3.
FIG. 5 sets forth a partial section view of the present invention doll taken along section lines 5—5 in FIG. 3.

FIG. 1 sets forth a perspective view of a toy figure constructed in accordance with the present invention and generally referenced by numeral 10. Toy FIG. 10 includes a body generally referenced by numeral 11 and having a generally spherical torso 12 supporting a generally spherical head 13. Head 13 supports a sleeve 50 which in turn slidably supports a shaft 51 having a ball 52 on the outer end thereof. The structure of shaft 51 and sleeve 50 is set forth below in greater detail in FIG. 3. However, suffice it to note here that shaft 51 is movable within sleeve 50 in the directions indicated by arrows 60 and 61. Head 13 further defines a pair of eye apertures 25 and 26 which receive generally spherical eye portions 27 and 28. Head 13 further defines a pair of ear apertures 36 and 37 which, in accordance with apparatus set forth below in FIG. 2, support a pair of extending generally hemispherical ears 38 and 39. Ears 38 and 39 are slidably movable by means set forth below in FIG. 2 in the directions indicated by arrows 66 and 67.

Torso 12 supports a pair of sleeves 55 and 56 which in turn slidably support a pair of arms 14 and 16. Arms 14 and 16 support respective hands 15 and 17. Arms 14 and 16 are slidably movable within sleeves 55 and 56 in the manner set forth below in FIG. 3. Suffice it to note here that arm 14 is movable inwardly in the direction indicated by arrow 63 and outwardly in the direction indicated by arrow 62. Similarly, arm 16 is movable inwardly in the direction indicated by arrow 65 and outwardly in the direction indicated by arrow 64.

Torso 12 further defines a pair of apertures 30 and 31 which in turn receive a pair of forwardly extending buttons 32 and 33. Buttons 32 and 33 are movable inwardly when pressed in the directions indicated by arrows 68 and 69 respectively.

Torso 12 further includes a pair of sleeves 57 and 58 which slidably support respective legs 20 and 22. Legs 20 and 22 support respective feet 21 and 23. By means set forth below in FIG. 3 in greater detail, legs 20 and 22 are slidably movable within sleeves 57 and 58. Thus, leg 20 is movable inwardly in the direction indicated by arrow 70 and outwardly in the direction indicated by arrow 71. Similarly, leg 22 is movable inwardly in the direction indicated by arrow 72 and outwardly in the direction indicated by arrow 73.

In operation and in accordance with the present invention, toy FIG. 10 further supports a sound circuit 100 (seen in FIG. 2) which provides a plurality of stored audible messages and sounds. By means also set forth below in greater detail, a plurality of switches operatively coupled to the internal sound circuit are positioned to be actuated as arms 14 and 16 as well as legs 20 and 22 are moved inwardly and outwardly. Further, a similar switch arrangement is provided which is actuated by inward and outward movement of shaft 51 as well as lateral movement of ears 38 and 39. In addition and by means also set forth below in FIG. 2 in greater detail, the lateral movement of ears 38 and 39 causes pivotal movement of eyes 27 and 28. Finally, a further pair of switches 77 and 78 are supported within torso 12 and are actuated by buttons 32 and 33. Switches 77 and 78 are of conventional fabrication and are operatively coupled to the internal sound circuit of toy FIG. 10.

Thus, each time the user manipulates any of the appendages of toy FIG. 10, a predetermined sound message or sound effect is created. Further, each time the user slides ears 38 and 39 laterally, eyes 27 and 28 pivot and a predetermined sound message or sound effect is produced. In addition, the lateral movement of ears 38 and 39 causes a pair of lights 85 and 86 (seen in FIG. 3) within ears 38 and 39 respectively to be energized producing a concurrent light effect.

similarly, movement of ball 52 and shaft 51 inwardly and outwardly causes the internal sound circuit to produce a still further predetermined sound message or sound effect. Finally, pressing either of buttons 32 or 33 causes the internal sound circuit of toy FIG. 10 to produce a still further alternate message or sound effect.

As a result, the child user is able to manipulate toy FIG. 10 to provide a variety of entertaining and amusing visual and sound effects. In particular, the use of sliding appendages and other members within toy FIG. 10 to trigger sound production provides a simultaneous visual alteration and sound effect which has been found to be extremely entertaining to young children. In the preferred fabrication of the present invention, toy FIG. 10 is fabricated of molded plastic relatively rigid components. Thus, body 11 having torso 12, head 13, arms 14 and 16, hands 15 and 17, legs 20 and 22 and feet 21 and 23 is preferably formed of rigid molded plastic members. Further, the preferred fabrication of shaft 51 and ball 52 as well as ears 38 and 39 and eyes 27 and 28 also utilizes a rigid molded plastic material in the preferred fabrication of the present invention.

FIG. 2 sets forth a partial section view of toy FIG. 10 taken along section lines 2—2 in FIG. 1. As described above, toy FIG. 10 includes a generally spherical head 13 having apertures 36 and 37 formed therein. As is also described above, head 13 defines a pair of eye apertures 25 and 26. A sound circuit 100 is fabricated in accordance with conventional fabrication techniques and is supported within the interior of head 13. Sound circuit 100 includes a conventional sound integrated circuit 101 configured to produce a plurality of stored audible messages and sound effects. Sound circuit 100, in accordance with conventional fabrication techniques, includes a memory having stored audio data and a microprocessor having a stored instruction set to provide sound signal output. It will be well understood by those skilled in the art that virtually any speech or sound circuit may be utilized in place of sound circuit 100. The essential characteristic of sound circuit 100 is the provision of appropriate signals to speaker 34 (seen in FIG. 3) for audiblizing a predetermined message or sound combination each time a switch within toy FIG. 10 is pressed. For example, a combination of a microprocessor, read-only memory, speech synthesizer, an audio output amplifier suitable for the functioning of sound circuit 100 is formed as a single integrated chip device manufactured by Texas Instruments, Inc. under the device name TMS50C44. However, it will be understood that a variety of standard integrated circuit devices may be utilized for sound circuit 100.

Toy FIG. 10 includes an ear frame 90 having a pair of outwardly facing sockets 91 and 92. Sockets 91 and 92 receive ears 38 and 39 and are secured thereto by conventional attachment such as adhesive attachment or the like. The extension of ears 38 and 39 through apertures 36 and 37 formed in head 13 provide a slidable support for the combination of ears 38 and 39 and ear frame 90. Ear frame 90 further defines an edge 98 having a rearwardly facing notch 97 formed therein. Correspondingly, sound circuit 100 includes a switch 102 positioned in alignment with edge 98 and notch 97 of ear frame 90. The operation of switch 102 and edge 98 and notch 97 is set forth below in FIG. 5 in greater detail. However, suffice it to note here that as ear frame 90 is moved laterally, switch 102 is actuated by the movement of notch 97 and edge 98.

Ear frame 90 further includes a pair of forwardly extending brackets 93 and 95 which define respective slots 94 and 96. Brackets 93 and 95 move laterally in the directions indicated by arrows 121 and 111 as ear frame 90 is correspondingly moved.

Head 13 further supports an eye frame 80 which includes a pair of notches 81 and 82. Eyes 27 and 28 are supported within apertures 25 and 26 of head 13 respectively by eye frame 80. Accordingly, eye 25 includes an elongated post 75 received within notch 81 while eye 26 includes an elongated post 76 received within notch 82. The cooperation of notches 81 and 82 with posts 75 and 76 provides the pivotal support for eyes 25 and 26.

In addition, eye 25 includes a rearwardly extending shaft 45 which in turn supports a pin 46. Pin 46 is received within slot 94 of bracket 93. Similarly, eye 28 includes a rearwardly extending shaft 47 having a pin 48 received within slot 96.

The cooperation of shafts 45 and 47 together with pins 46 and 48 within slots 94 and 96 of brackets 93 and 95 provides pivotal movement of eyes 27 and 28 in response to lateral movement of ear frame 90.

In operation, as ears 38 and 39 are moved laterally in the direction indicated by arrow 110, brackets 93 and 95 are moved in the direction indicated by arrow 111. This movement in turn pivots eyes 27 and 28 in the directions indicated by arrows 112 and 113 respectively. Conversely, lateral movement of ears 38 and 39 in the direction indicated by arrow 120 moves brackets 93 and 95 in the direction indicated by arrow 121. This in turn pivots eyes 27 and 28 in the directions indicated by arrows 122 and 123 respectively. Concurrently, the lateral movement of ears 38 and 39 in either of the directions indicated by arrows 110 and 120 moves notch 97 away from switch 102 causing switch 102 to be actuated by edge 98. In accordance with the operation of sound circuit 100, the signal provided by actuation of switch 102 produces a predetermined audible message or sound effect.

FIG. 3 sets forth a section view of toy FIG. 10 taken along section lines 3—3 in FIG. 2. Toy FIG. 10 includes a body 11 having a torso 12 and a head 13 both defining generally spherical shapes. Head 13 defines a pair of apertures 36 and 37 within which a pair of ears 38 and 39 are slidably supported. Head 13 further includes an upwardly extending sleeve 50 within which a shaft 51 having a ball 52 on the outer end thereof is slidably supported. Shaft 51 supports a cam ring 53 on its interior and which extends into head 13. A switch 54 is positioned within the travel path of cam ring 53 such that the vertical movement of shaft 51 and ball 52 moves cam ring 53 back and forth upon switch 54 causing the switch to be actuated. Head 13 further supports a sound circuit 100 having a plurality of digital electronic circuit components such as an integrated circuit 101. Sound circuit 100 further supports a switch 102 which, as is better seen in FIGS. 2 and 5, is actuated in response to the lateral movement of ears 38 and 39. An ear frame 90 includes a pair of outwardly facing sockets 91 and 92 which receive the interior ends of ears 38 and 39. Sockets 91 and 92 further support a pair of outwardly facing electric lightbulbs 85 and 86. The support of bulbs 85 and 86 is provided in accordance with conventional fabrication techniques (not shown). Correspondingly, ears 38 and 39 are preferably fabricated of a colored light transmissive material allowing light produced by bulbs 85 and 86 to travel outwardly from ears 38 and 39. Ear frame 90 further includes a pair of slots 99 and 106. A post 105 is secured to and extends forwardly from ear frame 90. A post 108 is supported beneath slot 99 such that post 108 extends upwardly therethrough. A second post 107 is supported within head 13 and extends through slot 106. A spring 115 is received upon post 107 and includes ends 116 and 117 positioned on each side of posts 105 and 108. Spring 115 provides a spring force which urges the combined structure of ear frame 90 and ears 38 and 39 toward the centered position shown in solid-line representation in FIG. 3. Accordingly, if for example ear frame 90 is displaced in the direction indicated by arrow 120, end 117 of spring 115 is flexed as shown in dashed-line representation producing a spring force which will return ear frame 90 and ears 38 and 39 to their centered positions. A corresponding effect results if ear frame 90 is displaced in the direction indicated by arrow 110 in which case end 116 of spring 115 provides the restoring force.

A speaker 34 is supported within head 13 and is operatively coupled to sound circuit 100 by a plurality of connecting wires in accordance with conventional fabrication techniques.

Torso 12 includes a center post 130 and a plurality of switches 141, 142, 143 and 144. Switches 141 through 144 are positioned in alignment between post 130 and sleeves 55, 57, 58 and 56 respectively. Arm 14 extends inwardly through sleeve 55 and supports a cam ring 131 at its interior end. Arm 16 extends inwardly through sleeve 156 and supports a cam ring 134 at its interior end. Similarly, legs 20 and 22 extend inwardly through sleeves 57 and 58 and support respective cam rings 132 and 133 at their interior ends.

By means not shown but in accordance with conventional fabrication techniques, switches 141 through 144 are operatively coupled to sound circuit 100 to provide signal inputs thereto.

The operation of switches 141 through 144 in response to movement of arms 14 and 16 as well as legs 20 and 22 is illustrated in FIG. 4 which sets forth the operation of switch 54 in response to movement of shaft 51. That is to say, the cooperation of arms 14 and 16 as well as legs 20 and 22 with their respective switches is substantially identical to the cooperation between shaft 51 and switch 54 shown in FIG. 4.

More specifically, as arm 14 is moved inwardly to the position shown in FIG. 3, cam ring 131 actuates switch 141. Conversely, as arm 14 is withdrawn from sleeve 55 moving hand 15 outwardly, cam ring 131 actuates switch 141 in the opposite direction. A similar operation takes place as arm 16 moves cam ring 134 inwardly actuating switch 144 and outwardly actuating switch 144 again as arm 16 is withdrawn. In the same manner, the inward movement of legs 20 and 22 causes cam rings 132 and 133 to actuate switches 142 and 143 while movement outwardly of legs 20 and 22 again actuates switches 142 and 143 as cam rings 132 and 133 pass over switches 142 and 143.

Thus, in operation, the movement of arms 14 and 16 as well as the movement of legs 20 and 22 together the movement of shaft 51 and ball 52 actuates the related switches operative within toy FIG. 10 producing signals coupled to sound circuit 100. In response, sound circuit 100 produces various audible messages and sound effects which are played on speaker 34. In addition, the lateral movement of ears 38 and 39 in either direction actuates switch 102 producing a signal which is coupled to sound circuit 100 causing the production of audible message or sound effect as well as the energizing of bulbs 85 and 86. Thus, as the child user alters the geometry of toy FIG. 10, each movement and each change in geometry is accompanied by an entertaining audible message or sound effect.

FIG. 4 sets forth a partial section view of toy FIG. 10 taken along section lines 4—4 in FIG. 3. As described above, shaft 51 is movable within sleeve 50 (seen in FIG. 3). As is also described above, shaft 51 supports a cam ring 53. A switch 54 positioned to place its actuator within the travel path of cam ring 53 is operatively coupled to sound circuit 100 (seen in FIG. 3). Switch 54 is fabricated in accordance with conventional fabrication techniques such that its actuator is urged outwardly in the direction indicated by arrow 127 to its normal position. As cam ring 53 moves across the actuator of switch 54, the actuator is forced inwardly in the direction indicator by arrow 128 thereby activating switch 154. The movement of cam ring 53 in each direction of shaft movement indicated by arrows 125 and 126 will actuate switch 54 as cam ring 53 moves across the switch. As mentioned above, the action of switch 54 in response to movement of shaft 51 is repeated and is substantially identical in the remaining shaft and switch combinations operative upon arms 14 and 16 as well as legs 20 and 22 (seen in FIG. 3).

FIG. 5 sets forth a partial section view of toy FIG. 10 taken along section lines 5—5 in FIG. 3. As described above, an ear frame 90 defines an edge 98 having a notch 97 formed therein. As is also described above, a switch 102 is positioned in proximity to edge 98 such that the movement of notch 97 across switch 102 actuates switch 102. This actuation occurs in both directions of motion of ear frame 90 indicated by arrows 135 and 136.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy figure comprising:

a body having a torso, defining a torso cavity and a head, defining a head cavity;

a sound circuit having a stored plurality of audible sounds and an electro-acoustic transducer;

a pair of arms slidably supported with said torso cavity by said torso each movable between an inward position and an outward position and each having an interior arm end, said interior arm ends each describing an arm end movement path between said inward and outward positions;

a pair of legs slidably supported within said torso cavity by said torso each movable between an inward position and an outward position and each having an interior leg end, said interior leg ends each describing a leg end movement path between said inward and outward positions;

a first pair of switches operatively coupled to said sound circuit, said first pair of switches supported within said torso cavity at positions proximate to said arm end movement paths causing said switches to be actuated by movement of said arms between said inward position and said outward position;

a second pair of switches operatively coupled to said sound circuit, said second pair of switches supported within said torso cavity at positions proximate to said leg end movement paths causing said switches to be actuated by movement of said legs between said inward position and said outward position, said sound circuit responding to actuation of said switches in said first and second pairs of switches to produce audible sound.

2. The toy figure set forth in claim 1 wherein said head defines a pair of ear apertures and wherein said toy figure further includes:

a pair of ears each slidably supported for lateral movement within said head to define a lateral movement path; and an ear switch supported within said head coupled to said sound circuit, said ear switch being proximate to said lateral movement path and being actuated by lateral movement of said ears to cause said sound circuit to produce an audible sound.

3. The toy figure set forth in claim 2 wherein said head includes a shaft having an interior shaft end slidably supported and movable between a raised and lowered position and a head switch supported within said head, said head switch operatively coupled to said sound circuit and actuated by movement of said shaft between said raised and said lowered position.

4. The toy figure set forth in claim 3 wherein said interior arm ends and said interior leg ends each include an annular cam ring actuating said first pair of switches and said second pair of switches respectively.

5. The toy figure set forth in claim 4 wherein said interior shaft end includes an annular cam ring.

6. The toy figure set forth in claim 1 wherein said interior arm ends and said interior leg ends each include an annular cam ring actuating said first pair of switches and said second pair of switches respectively.

7. The toy figure set forth in claim 6 wherein said head includes a shaft having an interior shaft end slidably supported and movable between a raised and lowered position and a head switch supported within said head, said head switch operatively coupled to said sound circuit and actuated by movement of said shaft between said raised position and said lowered position.

* * * * *